US008712283B2

(12) United States Patent
Kato

(10) Patent No.: US 8,712,283 B2
(45) Date of Patent: Apr. 29, 2014

(54) IMAGE FORMING APPARATUS

(75) Inventor: Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 180 days.

(21) Appl. No.: 13/361,540

(22) Filed: Jan. 30, 2012

(65) Prior Publication Data

US 2012/0219317 A1 Aug. 30, 2012

(30) Foreign Application Priority Data

Feb. 28, 2011 (JP) ..... 2011-042092

(51) Int. Cl.
*G03G 15/00* (2006.01)

(52) U.S. Cl.
USPC ..... 399/110; 399/111; 399/112

(58) Field of Classification Search
USPC ..... 399/110, 111, 112, 124
See application file for complete search history.

(56) References Cited

U.S. PATENT DOCUMENTS

| | | | | |
|---|---|---|---|---|
| 5,812,910 | A | 9/1998 | Kim | |
| 7,873,301 | B2 * | 1/2011 | Ishii | 399/111 |
| 8,326,176 | B2 * | 12/2012 | Takayama | 399/110 |
| 2005/0180797 | A1 | 8/2005 | Hattori | |
| 2007/0217818 | A1 | 9/2007 | Shiraki et al. | |
| 2007/0230998 | A1 | 10/2007 | Ishii | |

FOREIGN PATENT DOCUMENTS

| | | | |
|---|---|---|---|
| CN | 1669893 | A | 9/2005 |
| CN | 1912766 | A | 2/2007 |
| JP | H09-211976 | A | 8/1997 |
| JP | 2007-256351 | A | 10/2007 |
| JP | 2010-026541 | A | 2/2010 |
| JP | 2010-282234 | A | 12/2010 |

OTHER PUBLICATIONS

State Intellectual Property Office of the People's Republic of China, Notification of the First Office Action for Chinese Patent Application No. 201210020544.5 (counterpart to above-captioned patent application), mailed Mar. 5, 2014.

* cited by examiner

*Primary Examiner* — Hoang Ngo
(74) *Attorney, Agent, or Firm* — Baker Botts L.L.P.

(57) ABSTRACT

An image forming apparatus includes plural photosensitive drums; a belt which opposes the photosensitive drums; and a holder which collectively holds the photosensitive drums, and is movable between an outer position and an inner position. The holder includes a first handle unit which is provided at an upstream side, a second handle unit which is provided separately from the first handle unit at a downstream side, and an interfered portion which interferes with an apparatus main body. The second handle unit is movable between a protrusion position where the second handle unit protrudes from a top portion of the photosensitive drums and a retreat position where the second handle unit retreats therebelow. The interfered portion interferes with the apparatus main body to cause the second handle unit to be displaced from the protrusion position to the retreat position when the holder is mounted in the apparatus main body.

7 Claims, 7 Drawing Sheets

IMAGE FORMING APPARATUS

CROSS-REFERENCE TO RELATED APPLICATION

This application claims priority from Japanese Patent Application No. 2011-042092, filed on Feb. 28, 2011, the entire subject matter of which is incorporated herein by reference.

TECHNICAL FIELD

Aspects of the present invention relate to a holder which collectively holds a plurality of photosensitive drums and an image forming apparatus including the holder.

BACKGROUND

A related-art electro-photographic image forming apparatus includes a plurality of photosensitive drums which are aligned in a predetermined alignment direction, an intermediate transfer belt which is provided above the plurality of photosensitive drums, and a holder which collectively holds the plurality of photosensitive drums and can be taken out in the alignment direction from a main body of the apparatus (for example, see JP-A-2010-282234). Specifically, in this image forming apparatus, a handle is provided on a front wall face of the holder, and a user can hold the handle and withdraw the holder from the main body of the apparatus.

In order to make it easily hold the holder when the user takes out the withdrawn holder from the main body of the apparatus, it may be advantageous to provide a handle also on a rear wall side of the holder. However, if a handle is provided on the rear wall side, when the holder is installed in the main body of the apparatus, the handle on the rear wall side may interfere with the intermediate transfer belt to damage the intermediate transfer belt.

SUMMARY

Accordingly, an aspect of the present invention provides a holder and an image forming apparatus capable of preventing a belt from being damaged by a handle of a holder.

According to an illustrative embodiment of the present invention, there is provided an image forming apparatus comprising: an apparatus main body; a plurality of photosensitive drums which are aligned in an alignment direction; a belt which is provided to oppose the plurality of photosensitive drums; and a holder which is configured to collectively hold the plurality of photosensitive drums, and configured to be moved in the alignment direction between an outer position located at an outside of the apparatus main body and an inner position located at an inside of the apparatus main body. The holder includes: a first handle unit which is provided at an upstream side of the photosensitive drums in a mounting direction of the holder moved from the outer position to the inner position; a second handle unit which is provided separately from the first handle unit at a downstream side in the mounting direction; and an interfered portion which is configured to interfere with the apparatus main body. The second handle unit is supported by the holder to be movable between a protrusion position where the second handle unit protrudes from a top portion of the plurality of the photosensitive drums and a retreat position where the second handle unit retreats below the top portion of the plurality of the photosensitive drums. The interfered portion is configured to interfere with the apparatus main body to cause the second handle unit to be displaced from the protrusion position to the retreat position, and when the holder is moved in the mounting direction, before the second handle unit reaches the belt, the interfered portion interferes with the apparatus main body.

According the above configuration, since the holder includes the first handle unit and the second handle unit, a user can easily hold the holder. Further, when the holder is moved in the mounting direction from the outer position, before the second handle unit reaches the belt, the interfered portion interferes with the apparatus main body such that the second handle unit is displaced from the protrusion position to the retreat position. Therefore, it is possible to prevent the second handle unit from coming into contact with the belt to damage the belt.

According to another illustrative embodiment of the present invention, there is provided a holder configured to collectively hold a plurality of photosensitive drums and configured to be mountable in an apparatus main body of an image forming apparatus in a mounting direction. The holder comprises: a first handle unit which is provided at an upstream side of the photosensitive drums in the mounting direction; a second handle unit which is provided separately from the first handle unit at a downstream side in the mounting direction; and an interfered portion which is configured to interfere with the apparatus main body, wherein the second handle unit is supported by the holder to be movable between a protrusion position where the second handle unit protrudes from a top portion of the plurality of the photosensitive drums and a retreat position where the second handle unit retreats below the top portion of the plurality of the photosensitive drums, and wherein the interfered portion is configured to interfere with the apparatus main body to cause the second handle unit to be displaced from the protrusion position to the retreat position, and when the holder is moved in the mounting direction, the interfered portion interferes with the apparatus main body.

According to the present invention, it is possible to prevent the belt from damaged by the second handle unit.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

<Overall Configuration of Color Printer>

Hereinafter, an illustrative embodiment of the present invention will be described in detail with reference to the drawings. In the following description, first, an overall configuration of a color printer 1 (an example of an image forming apparatus) will be described, and then a portion related to the present invention will be described in detail.

Figure 1:
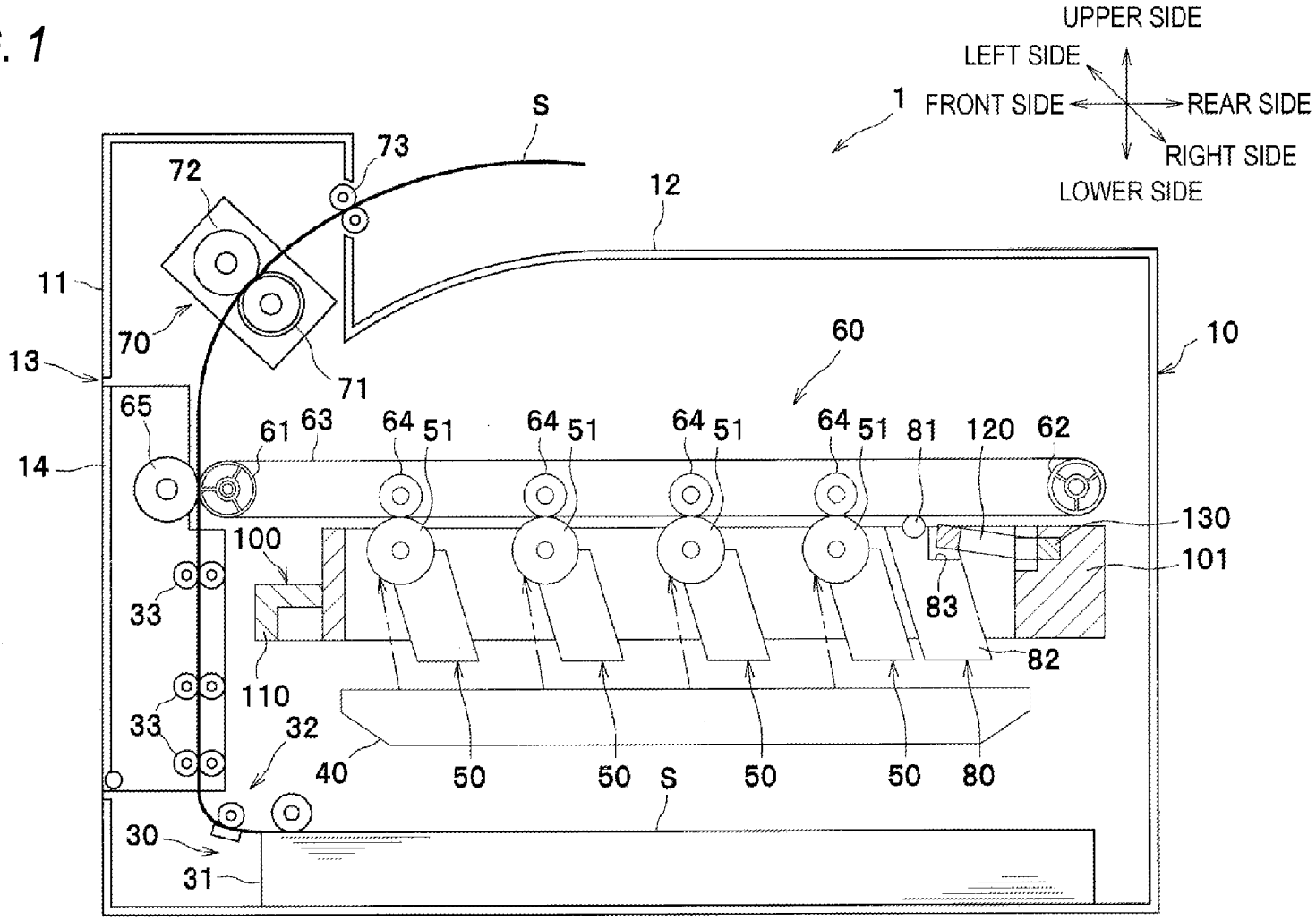
FIG. 1 is a view schematically illustrating a color printer according to an illustrative embodiment of the present invention in a state where a holder is mounted at an inner position.

In the following description, directions will be described as directions relative to a user who uses the color printer 1. That is, the left side, the right side, the front side, and rear side in FIG. 1 are referred to as the front side, the rear side, the right side, and the left side, respectively. Further, the upper side and the lower side in FIG. 1 are referred to as the upper side and the lower side, respectively.

As shown in FIG. 1, the color printer 1 includes a sheet feeding unit 30, a scanner unit 40, four process cartridges 50, a holder 100, a transfer unit 60, a fixing unit 70, and a belt cleaner 80, in an apparatus main body 10.

At the upper portion of the apparatus main body 10, a sheet discharge tray is provided to receive sheets S discharged from the apparatus main body 10. At a front wall 11 of the apparatus main body 10, an opening 13 is formed to allow the holder 100 to be withdrawn from the apparatus main body 10, and a front cover 14 for opening and closing the opening 13 is provided to be rotatable. The front cover 14 integrally supports a plurality of pairs of conveyance rollers 33 and a secondary transfer roller 65.

The sheet feeding unit 30 is provided at a lower portion in the apparatus main body 10, and includes a sheet feed tray 31 for accommodating sheets S, and a sheet feeding mechanism 32 having the plurality of pairs of conveyance rollers 33 for conveying a sheet S from the sheet feed tray 31 to a transfer position (between an intermediate transfer belt 63 and the secondary transfer roller 65). The sheets S in the sheet feed tray 31 are conveyed to the transfer position one by one by the sheet feeding mechanism 32.

The scanner unit 40 is provided below the four process cartridges 50, and includes a laser emission unit, a polygon mirror, a lens, reflective mirrors, and the like (not shown). A laser beam for each color of cyan, magenta, yellow, and black emitted from the laser emission unit, is reflected by the polygon mirror and the reflective mirrors, passes through the lens, and is irradiated onto a surface of each photosensitive drum 51 with high-speed scan.

The process cartridges 50 are aligned in a front-rear direction (predetermined direction) above the sheet feeding unit 30, and each of process cartridges 50 includes a charger, a developing roller, a supply roller, a layer-thickness regulating blade, a toner container, and the like (not shown).

The holder 100 collectively holds the four process cartridges 50 and the belt cleaner 80. Further, the holder 100 is supported to be movable in the front-rear direction in the apparatus main body 10 and is configured to be movable between an outer position (a position shown in FIG. 2) located at the outside of the apparatus main body 10 and an inner position (a position shown in FIG. 1) located at the inside of the apparatus main body 10, in the front-rear direction, and mountable and removable with respect to the apparatus main body 10.

The transfer unit 60 is provided above the process cartridges 50 (photosensitive drums 51), and includes a driving roller 61, a driven roller 62, the endless intermediate transfer belt 63 (belt) wound around the driving roller 61 and the driven roller 62, four primary transfer rollers 64 provided to oppose the photosensitive drums 51 with the intermediate transfer belt 63 interposed therebetween, and the secondary transfer roller 65 provided to oppose the drive roller 61 with the intermediate transfer belt 63 interposed therebetween.

In the process cartridges 50 and the transfer unit 60, the surfaces of the photosensitive drums 51 are uniformly charged by the chargers, and are exposed by the scanner unit 40, such that electrostatic latent images are formed on the photosensitive drums 51 based on image data. Further, the toner in the toner containers is carried onto the surfaces of the developing rollers through the supply rollers.

The toner carried on the developing rollers are supplied from the developing rollers to the electrostatic latent images on the photosensitive drums 51. Therefore, the electrostatic latent images are visualized, that is, toner images are formed (carried) on the photosensitive drums 51. The toner images of the respective colors formed on the photosensitive drums 51 are sequentially transferred onto the intermediate transfer belt 63 to overlap. Then, when a sheet S fed from the sheet feeding unit 30 passes the transfer position between the intermediate transfer belt 63 and the secondary transfer roller 65, the toner image on the intermediate transfer belt 63 is transferred onto the sheet S.

The fixing unit 70 is provided above the transfer unit 60, and includes a heating roller 71, a pressing roller 72 which is provided to oppose the heating roller 71 and presses the heating roller 71, and discharging rollers 73 which discharges the sheet S having been subject to fixing, to the outside of the apparatus main body 10. In the fixing unit 70, when the sheet S having the toner image transferred thereon passes between the heating roller 71 and the pressing roller 72, the toner image is fixed by heat, and then the sheet S is discharged to the outside of the apparatus main body 10 by the discharging rollers 73 so as to be received on the sheet discharge tray 12.

The belt cleaner 80 is provided at an upstream of the process cartridges 50 in the rotation direction of the intermediate transfer belt 63, in parallel with the four process cartridges 50, and is configured to clean the intermediate transfer belt 63. The belt cleaner 80 mainly includes a cleaning roller 81 and a collecting box 82.

The cleaning roller 81 comes into slidable contact with the intermediate transfer belt 63 and scrapes residual toner or paper powder off the surface of the intermediate transfer belt 63. Then, the toner and the like attached to the cleaning roller 81 are scraped off by a collecting roller or a blade (not shown) and are dropped into the collecting box 82.

The collecting box 82 is a container which accommodates toner and the like scraped off the cleaning roller 81, and has a recess portion 83 which is formed on the rear side of the upper face and accommodates a second handle unit 120 (to the described later) when the second handle unit 120 is at the retreat position.

Figure 4A:
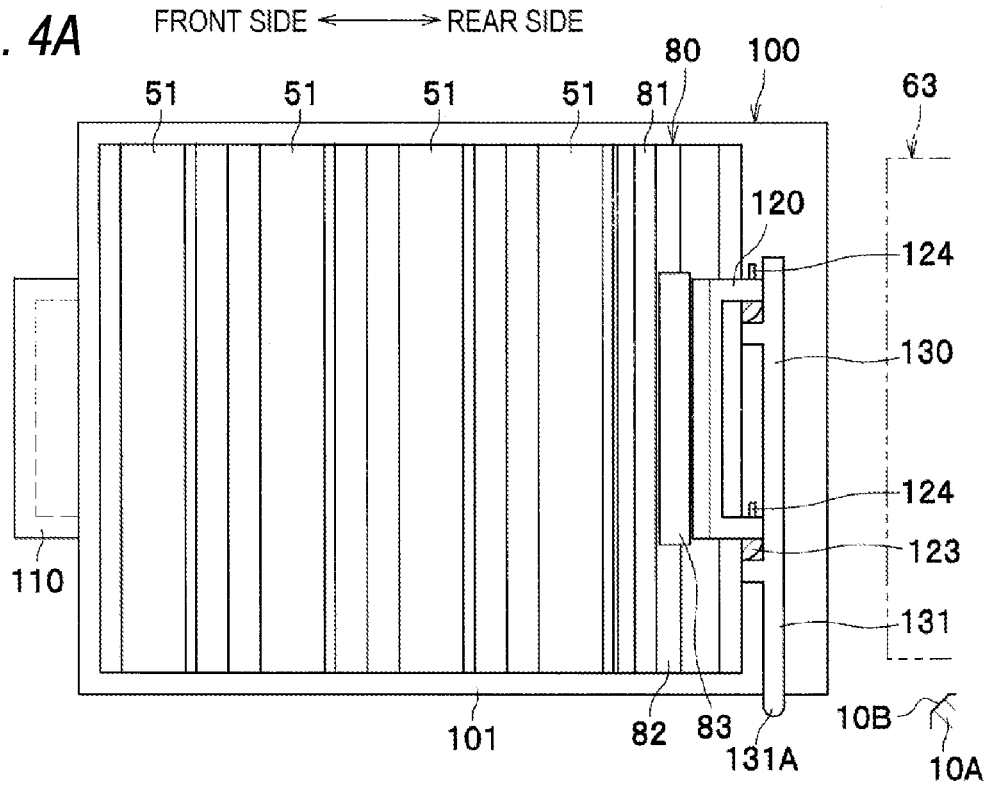
FIG. 4A is a top view of the holder when the holder is at the outer position.
Figure 4B:
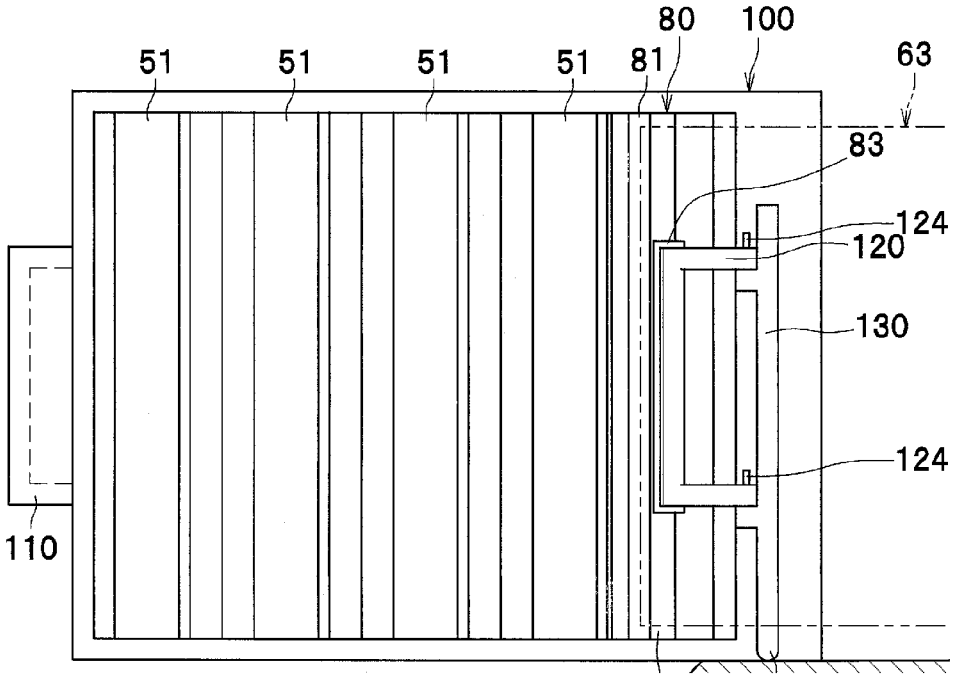
FIG. 4B is a top view of the holder when the holder is at the inner position.

As shown in FIGS. 4A and 4B, inside the apparatus main body 10, an interfering portion 10A which is configured to interfere with an interfered portion 130 (to be described later) is formed to extend from the vicinity of a front end of the intermediate transfer belt 63 to the vicinity of a rear end of the intermediate transfer belt 63, at an outside of the intermediate transfer belt 63 in an axis direction of the photosensitive drums 51.

Figure 2:
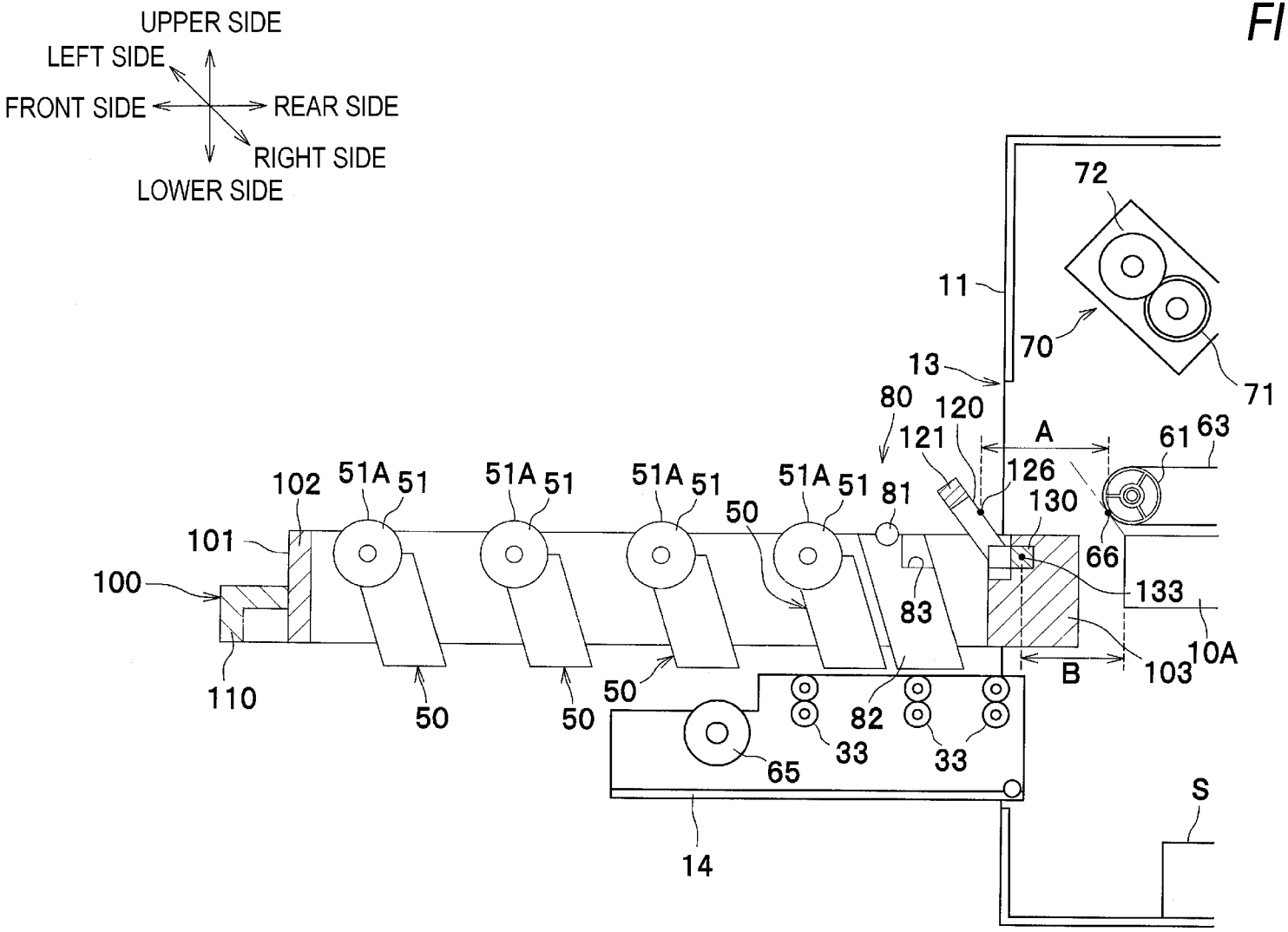
FIG. 2 is a view illustrating a state where the holder is withdrawn at an outer position.

Specifically, as shown in FIG. 2, the second handle unit 120, the intermediate transfer belt 63, the interfered portion 130, and the front end of the interfering portion 10A are provided such that, when the holder 100 is at the outer position, the shortest distance A between the second handle unit 120 and the intermediate transfer belt 63 (the shortest distance in a mounting direction) is larger than the shortest distance B between the interfered portion 130 and the interfering portion 10A. Herein, the shortest distance A is defined as a distance from a contact point 126 of the second handle unit 120 with the intermediate transfer belt 63 to a contact point 66 of the intermediate transfer belt 63 with the second handle unit 120 if the holder 100 were moved from the outer position to the inner position while the second handle unit 120 is not displaced from the protrusion position to the retreat position. The shortest distance B is defined as a distance from the interfered portion 130 (a first contact point 133 of the interfered portion 130 with the interfering portion 10A) to the front end of the interfering portion 10A (a first contact point of the interfering portion 10A with the interfered portion 130). Accordingly, when the holder 100 is moved in the mounting direction, the interfered portion 130 is interfered with the interfering portion 10A before the second handle unit 120 reaches the intermediate transfer belt 63, so that the second handle unit 120 falls down from the protrusion position toward the retreat position.

A rear end of the interfering portion 10A extends to at least a position where as long as the holder 100 is at the inner position, the rear end of the interfering portion 10A and the interfered portion 130 overlap each other (are at the same position in the mounting direction) as seen from a left-right direction. Accordingly, whenever the second handle unit 120 is located below the intermediate transfer belt 63, the interfering portion 10A and the interfered portion 130 interfere with each other, and therefore, it is possible to maintain the second handle unit 120 at the retreat position.

<Configuration of Holder>

Next, a configuration of the holder 100 will be described in detail. In the following description, a movement direction of the holder 100 from the outer position to the inner position is referred to as the mounting direction.

As shown in FIGS. 1 and 2, the holder 100 mainly includes a frame 101, a first handle unit 110, the second handle unit 120, and the interfered portion 130 (see FIG. 4A).

The frame 101 is a rectangular frame, and collectively accommodates the four process cartridges 50 and the belt cleaner 80 in parallel in the front-rear direction.

The first handle unit 110 is provided at a lower portion of a front wall 102 of the frame 101 provided on the upstream side of the photosensitive drums 51 in the mounting direction. The first handle unit 110 has a recess portion open at a lower face thereof, and the user can insert a finger into the recess portion to hold the first handle unit 110.

The second handle unit 120 is provided to be rotatable on a rear wall 103 of the frame 101 which is provided at a position separated from the first handle unit 110 toward the downstream side in the mounting direction. The second handle unit 120 is configured to be rotatable (movable) between the protrusion position (the position shown in FIG. 2) where the second handle unit 120 protrudes upward from the top portions 51A of the four photosensitive drums 51 and the retreat position (the position shown in FIG. 1) where the second handle unit 120 retreats to the side below the top portions 51A of the four photosensitive drums 51.

Figure 3A:
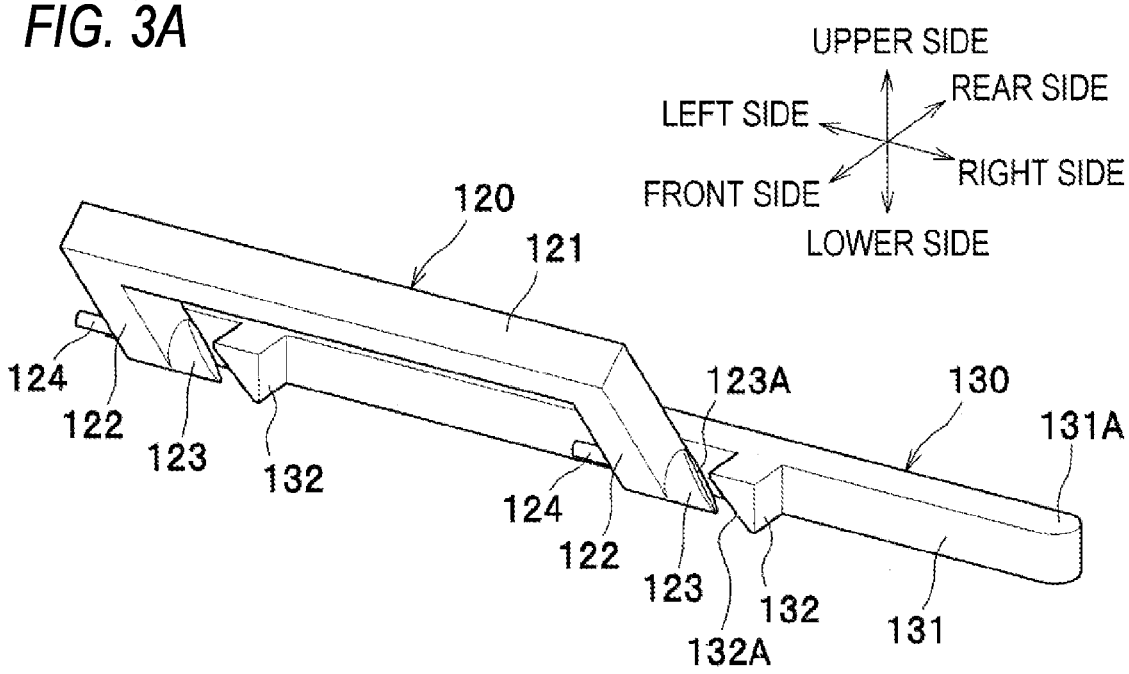
FIG. 3A is a view illustrating a second handle unit and an interfered portion when the second handle unit is at a protrusion position.

Specifically, as shown in FIGS. 2 and 3A, the second handle unit 120 includes a grip portion 121 and a pair of arm portions 122. When the second handle unit 120 is at the protrusion position, the grip portion 121 extends in the left-right direction above the top portions 51A of the four photosensitive drums 51, and the arm portions 122 extends obliquely downward from both ends of the grip portion 121. The pair of arm portions 122 includes rotation shafts 124 formed on the left surfaces thereof, and the rotation shafts 124 are supported by the frame 101 such that the second handle unit 120 is rotatable with respect to the frame 101.

Figure 5A:
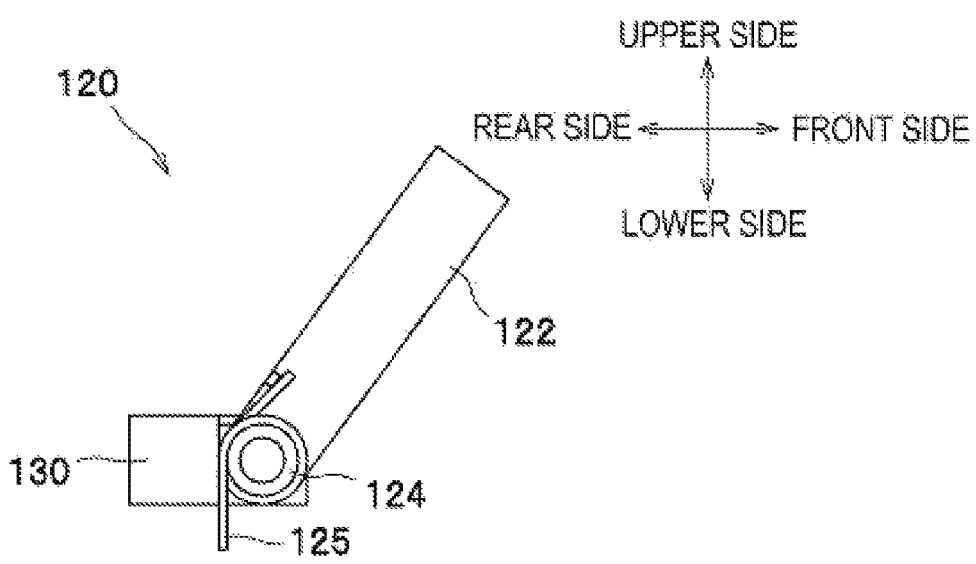
FIG. 5A is a view illustrating a torsion coil spring when the second handle unit is at the protrusion position.
Figure 5B:
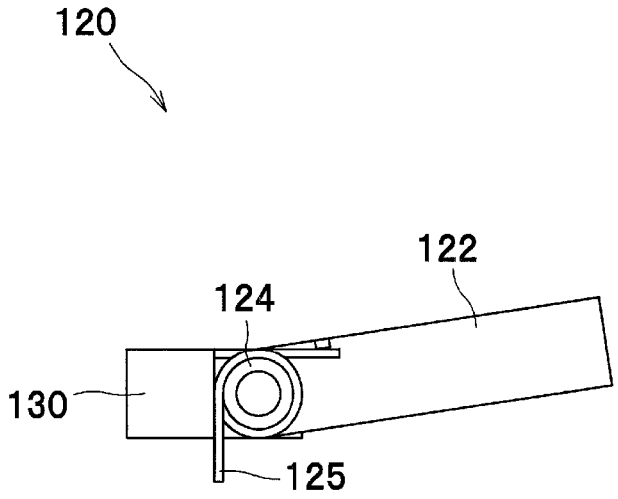
FIG. 5B is a view illustrating the torsion coil spring when the second handle unit is at the retreat position.

Further, as shown in FIGS. 5A and 5B, on the rotation shafts 124 of the arm portions 122, torsion coil springs 125 (biasing member) are supported. Each of the torsion coil springs 125 has one end abutting the interfered portion 130 and the other end abutting the arm portions 122, so that the torsion coil springs 125 biases the second handle unit 120 from the retreat position (a position shown in FIG. 5B) toward the protrusion position (a position shown in FIG. 5A). Further, the frame 101 includes a regulating unit (not shown) configured to contact the second handle unit 120 when the second handle unit 120 is at the protrusion position, thereby regulating the position of the second handle unit 120 at the protrusion position.

As shown in FIG. 3A, on the right face of each arm portion 122, a connection portion 123 is formed to protrude to the right side and interact with an operation portions 132 of the interfered portion 130 (to be described later).

The interfered portion 130 is connected with the second handle unit 120, and interferes with the interfering portion 10A of the apparatus main body 10 so as to cause the second handle unit 120 to be displaced from the protrusion position to the retreat position.

Specifically, as shown in FIGS. 3A and 4A, the interfered portion 130 is formed from a rod-shaped member 131 extending in the left-right direction, and is supported on the rear side of the second handle unit 120 by the frame 101 such that the interfered portion 130 is movable in the left-right direction. The rod-shaped member 131 is configured such that, when the holder 100 is at the outer position, a right end potion 131A of the rod-shaped member 131 protrudes outward from the holder 100, and when the holder 100 is moved in the mounting direction from the outer position, the right end potion 131A interferes with an inclined surface 10B which is at the front end of the interfering portion 10A of the apparatus main body 10, so that the rod-shaped member 131 is pressed to move toward the left side by the inclined surface 10B.

Further, the rod-shaped member 131 includes the operation portions 132, which protrude forward on the right sides of the connection portions 123 of the second handle unit 120 and operate on the connection portions 123 of the second handle unit 120. The operation portions 132 may or may not be in contact with the connection portions 123 when the holder 100 is at the outer position.

Figure 3B:
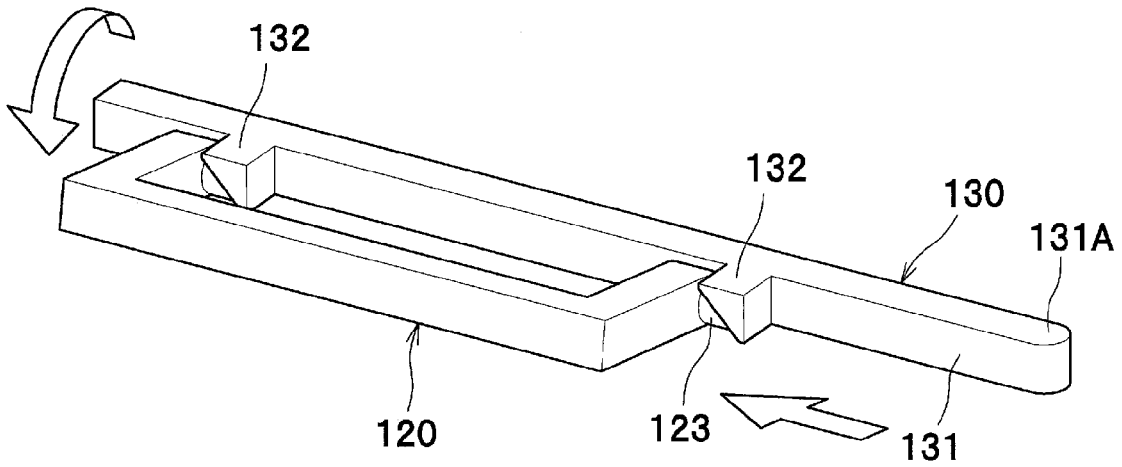
FIG. 3B is a view illustrating the second handle unit and the interfered portion when the second handle unit is at a retreat position.

The operation portions 132 are inclined from the upper left side toward the lower right side, and have surfaces 132A to come into contact with the connection portions 123, respectively. Meanwhile, the connection portions 123 have surfaces 123A which are clockwise twisted in relative to the surfaces 132A of the operation portions 132 as seen from the right side when the second handle unit 120 is at the protrusion position. The surfaces 123A of the connection portions 123 gradually get together with the surfaces 132A of the operation portions 132 when the operation portions 132 move from the right side to the left side. As described above, since the twisted surfaces gradually get together with each other, as shown FIG. 3B, the arm portions 122 rotate counterclockwise as seen from the right side. Accordingly, the second handle unit 120 moves from the protrusion position to the retreat position.

When the holder 100 configured as described above is moved in the mounting direction, as shown in FIGS. 4A and 4B, before the second handle unit 120 reaches the intermediate transfer belt 63, the right end potion 131A of the interfered portion 130 interferes with the interfering portion 10A of the apparatus main body 10, so that the entire interfered portion 130 moves to the left side. Therefore, the second handle unit 120 is displaced from the protrusion position to the retreat position.

When the holder 100 is moved from the inner position to the outer position, the interference between the right end potion 131A of the interfered portion 130 and the interfering portion 10A of the apparatus main body 10 is released, such that the second handle unit 120 is displaced from the retreat position to the protrusion position by the biasing force of the torsion coil springs 125. In this case, the surfaces 123A of the connection portions 123 become the original twisted state, and the interfered portion 130 returns to the original position.

According to the above-described configuration, it may be possible to obtain the following effects. That is, since the holder 100 includes the first handle unit 110 and the second handle unit 120, when taking the holder 100 out of the apparatus main body 10, the user can easily hold the holder 100. Further, since the second handle unit 120 falls down before coming into contact with the intermediate transfer belt 63, when the holder 100 is at the inner position, it is possible to prevent the second handle unit 120 from coming into contact with the intermediate transfer belt 63 to damage the intermediate transfer belt 63.

Furthermore, since the second handle unit 120 includes the torsion coil springs 125 which bias the second handle unit 120 from the retreat position to the protrusion position, when the holder 100 is moved to the outer position, the second handle unit 120 automatically moves from the retreat position to the protrusion position.

While the present invention has been shown and described with reference to certain illustrative embodiments thereof, it will be understood by those skilled in the art that various changes in form and details may be made therein without departing from the spirit and scope of the invention as defined by the appended claims.

In the above-described illustrative embodiment, the second handle unit 120 and the interfered portion 130 are formed separately. However, the present invention is not limited thereto. For example, the second handle unit and the interfered portion may be formed integrally.

Figure 6A:
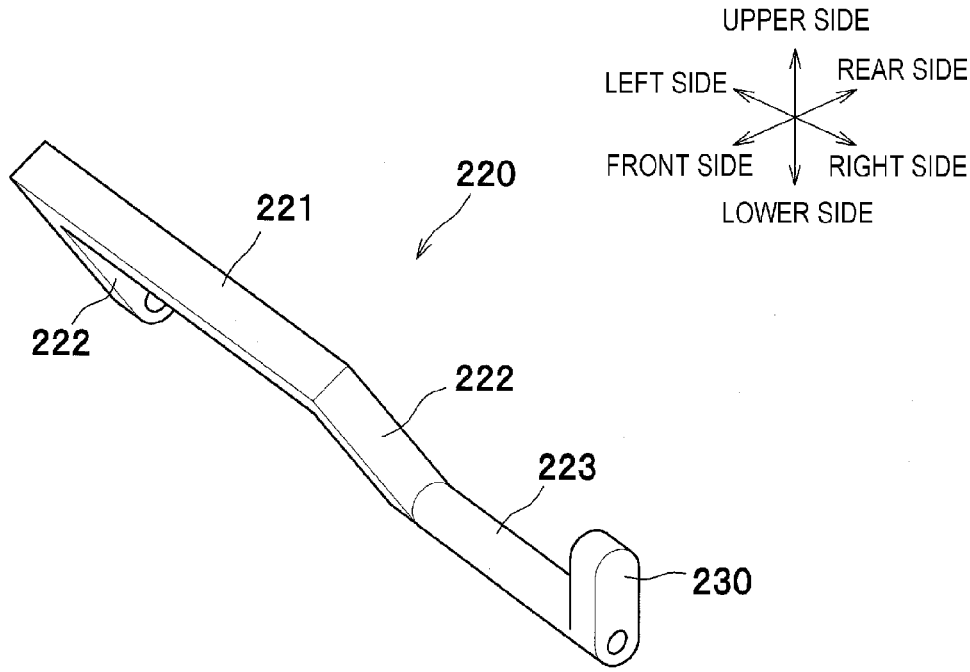
FIG. 6A is a view illustrating a second handle unit and an interfered portion according to a modified example when the second handle unit is at a protrusion position.
Figure 7A:
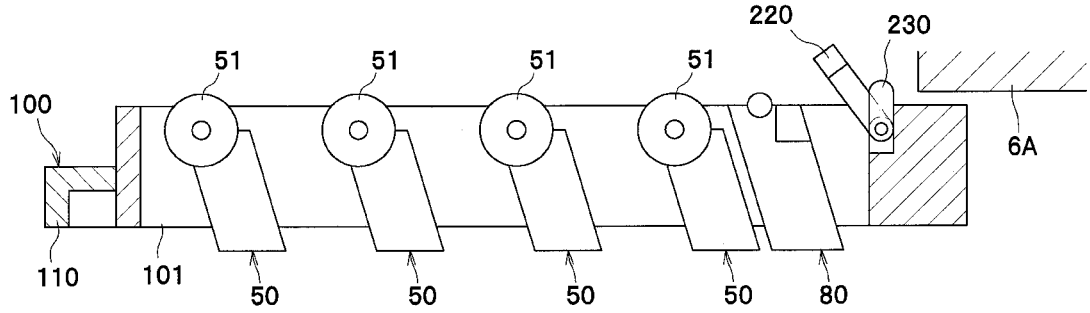
FIG. 7A is a top view of a holder according to the modified example when the holder is at the outer position.

Specifically, a second handle unit 220 includes a grip portion 221, a pair of arm portions 222, a connection portion 223, and an interfered portion 230. When the second handle unit 220 is at the outer position as shown in FIGS. 6A and 7A, the pair of arm portions 222 extend obliquely downward from both ends of the grip portion 221, the connection portion 223 extends from the lower end of the right arm portion 222 to the right side, and the interfered portion 230 extends upward from the right end of the connection portion 223.

Figure 6B:
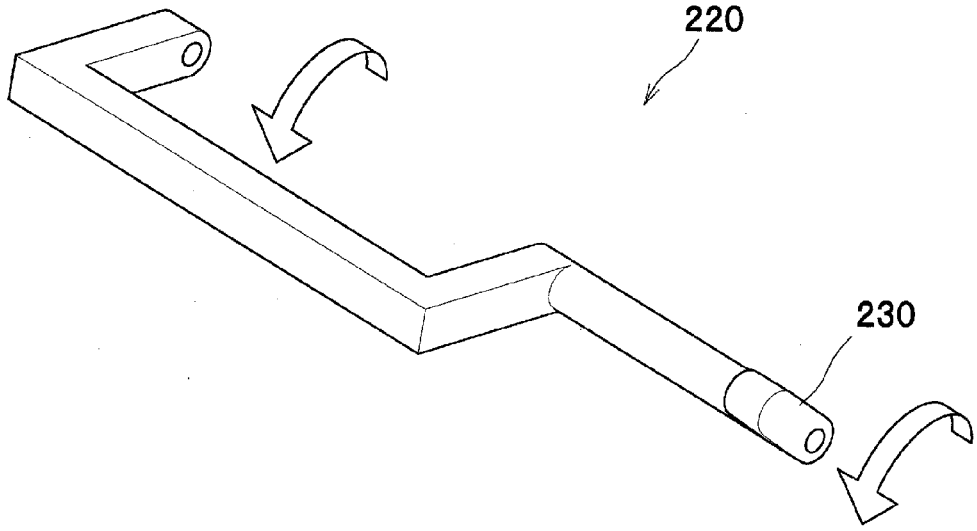
FIG. 6B is a view illustrating the second handle unit and the interfered portion according to the modified example when the second handle unit is at a retreat position.
Figure 7B:
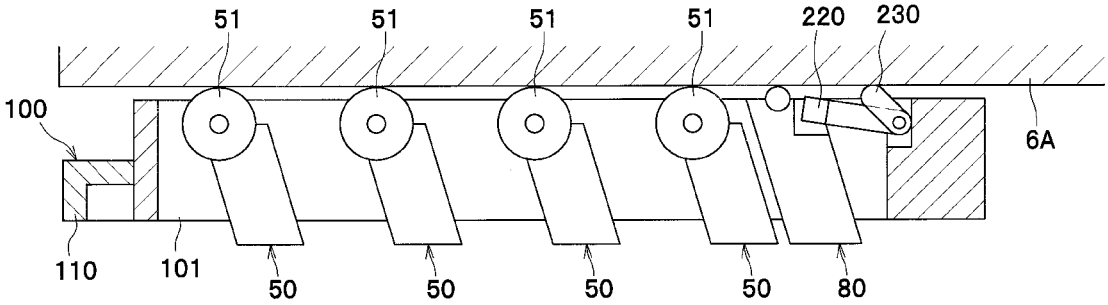
FIG. 7B is a top view of the holder according to the modified example when the holder is at the inner position.

When the holder 100 is moved in the mounting direction, as shown in FIGS. 6B and 7B, the interfered portion 230 of the second handle unit 220 configured as described above falls forward by interference between the interfered portion 230 and a right frame 6A (interfering portions) of a belt unit 6 provided in the apparatus main body 10. As a result, the second handle unit 220 is displaced from the protrusion position to the retreat position. Therefore, it is possible to obtain the same effects as those of the above-described illustrative embodiment. In this modified example, the interfered portion 230 is provided only to the right end of the second handle unit 220. However, the interfered portion 230 may be provided to both ends of the second handle unit 220.

As another modified example where a second handle unit and an interfered portion are integrally formed, a second handle unit having interfered portions which protrude upward at both end portions of a grip portion longer than a gap in the left-right direction between the left and right frames 6A (interfering portions) of the belt unit 6, and interfere with the frames 6A may be used.

In the above-described illustrative embodiments, as an example of a biasing member provided to the second handle unit 120, the torsion coil springs 125 are used. However, the present invention is not limited thereto. For example, as the biasing member, the rising force of the second handle unit 120 from the retreat position to the protrusion position by the self weight of the second handle unit 120 may be used.

In the above-described illustrative embodiment, the biasing member is provided to the second handle unit 120 to bias the second handle unit 120 from the retreat position to the protrusion position. However, the present invention is not limited thereto. The biasing member may not be provided to the second handle unit 120. For example, when the holder 100 is at the outer position, the user may hold the grip portion 121 to move the second handle unit 120 that is at the retreat position, to the protrusion position.

In the above-described illustrative embodiment, the second handle unit 120 is provided on the rear wall 103 of the frame 101. However, the present invention is not limited thereto. For example, the second handle unit 120 may be provided at a middle portion of the holder 100 in the front-rear direction.

In the above-described, the present invention is applied to the color printer 1. However, the present invention is not limited thereto, but may be applied to a copy machine, a multi-function apparatus, and the like.

What is claimed is:

1. An image forming apparatus comprising:

an apparatus main body;

a plurality of photosensitive drums which are aligned in an alignment direction;

a belt which is provided to oppose the plurality of photosensitive drums; and a holder which is configured to collectively hold the plurality of photosensitive drums, and configured to be moved in the alignment direction between an outer position located at an outside of the apparatus main body and an inner position located at an inside of the apparatus main body, wherein the holder includes:

a first handle unit which is provided at an upstream side of the photosensitive drums in a mounting direction of the holder moved from the outer position to the inner position;

a second handle unit which is provided separately from the first handle unit at a downstream side in the mounting direction; and an interfered portion which is configured to interfere with the apparatus main body, wherein the second handle unit is supported by the holder to be movable between a protrusion position where the second handle unit protrudes from a top portion of the plurality of the photosensitive drums and a retreat position where the second handle unit retreats below the top portion of the plurality of the photosensitive drums, and wherein the interfered portion is configured to interfere with the apparatus main body to cause the second handle unit to be displaced from the protrusion position to the retreat position, and when the holder is moved in the mounting direction, before the second handle unit reaches the belt, the interfered portion interferes with the apparatus main body.

2. The image forming apparatus according to claim 1, wherein the second handle unit includes a biasing member which biases the second handle unit from the retreat position to the protrusion position.

3. The image forming apparatus according to claim 1, wherein the apparatus main body includes an interfering portion which is formed at an outside of the belt in an axis direction of the photosensitive drums and interferes with the interfered portion.

4. The image forming apparatus according to claim 1, further comprising:

a belt cleaner which is held by the holder and contacts the belt to clean the belt when the holder is at the inner position, wherein the belt cleaner has a recess portion to accommodate the second handle unit when the second handle is displaced into the retreat position.

5. A holder configured to collectively hold a plurality of photosensitive drums and configured to be mountable in an apparatus main body of an image forming apparatus in a mounting direction, the holder comprising:

a first handle unit which is provided at an upstream side of the photosensitive drums in the mounting direction;

a second handle unit which is provided separately from the first handle unit at a downstream side in the mounting direction; and an interfered portion which is configured to interfere with the apparatus main body, wherein the second handle unit is supported by the holder to be movable between a protrusion position where the second handle unit protrudes from a top portion of the plurality of the photosensitive drums and a retreat position where the second handle unit retreats below the top portion of the plurality of the photosensitive drums, and wherein the interfered portion is configured to interfere with the apparatus main body to cause the second handle unit to be displaced from the protrusion position to the retreat position, and when the holder is moved in the mounting direction, the interfered portion interferes with the apparatus main body.

6. The holder according to claim 5, wherein the interfered portion is movable in an axis direction of the photosensitive drums between a protrusion state and a retreat state, and wherein when the interfered portion is moved from the protrusion state to the retreat state, the interfered portion causes the second handle unit to be displaced from the protrusion position to the retreat position.

7. The holder according to claim 5, wherein the interfered portion is rotatable about an axis extending in an axis direction of the photosensitive drums, and wherein while the interfered portion rotates about the axis, the interfered portion causes the second handle unit to be displaced from the protrusion position to the retreat position.

* * * * *